US011654532B1

(12) United States Patent
Chen

(10) Patent No.: US 11,654,532 B1
(45) Date of Patent: May 23, 2023

(54) FIXTURE

(71) Applicant: YUE DAR INDUSTRY CO., LTD, Taichung (TW)

(72) Inventor: Po-Shen Chen, Taichung (TW)

(73) Assignee: YUE DAR INDUSTRY CO., LTD, Taichung (TW)

( * ) Notice: Subject to any disclaimer, the term of this patent is extended or adjusted under 35 U.S.C. 154(b) by 0 days.

(21) Appl. No.: 17/552,540

(22) Filed: Dec. 16, 2021

(51) Int. Cl.
*B25B 1/10* (2006.01)
*B25B 1/02* (2006.01)

(52) U.S. Cl.
CPC ..... *B25B 1/103* (2013.01); *B25B 1/02* (2013.01)

(58) Field of Classification Search
CPC .. B25B 1/103; B25B 1/02; B25B 1/00; B25B 5/00; B25B 1/24; B25B 1/20; B25B 5/067; B25B 5/101; B25B 5/125
USPC ..... 269/43, 45, 56, 309, 310
See application file for complete search history.

(56) References Cited

FOREIGN PATENT DOCUMENTS

| | | | |
|---|---|---|---|
| TW | 339003 U | | 8/1998 |
| TW | I603807 B | | 11/2017 |
| TW | 201808516 A | * | 3/2018 |

* cited by examiner

*Primary Examiner* — Lee D Wilson
*Assistant Examiner* — Tyler James McFarland
(74) *Attorney, Agent, or Firm* — Alan D. Kamrath; Karin L. Williams; Mayer & Williams PC

(57) ABSTRACT

A fixture is mounted on a work platform and contains: a first movable block, a second movable block, an actuation block, multiple resilient elements, multiple first connection blots, and a threaded bolt. The first movable block includes a first body having a first tilted face, a first defining portion, and a first clamping face. The second movable block includes a second body having a second tilted face, a second defining portion, and a second clamping face. The actuation block includes a third body having a third tilted face, a fourth tilted face, at least one first abutting portion, at least second abutting portion, and a coupling orifice. The third tilted face corresponds to the first tilted face and has a third defining portion, and the third tilted face has a fifth slide section, a sixth slide section, and a third stop section.

5 Claims, 14 Drawing Sheets

FIXTURE

FIELD OF THE INVENTION

The present invention related to clamping equipment for clamping workpieces of various shapes, and more particularly to a fixture which clamps the workpieces of different heights at any angles and does not swing, thus avoiding a removal of the workpieces.

BACKGROUND OF THE INVENTION

A conventional vise contains a fixed jaw formed on an end thereof and a movable jaw slidably fixed on a top of the vise and driven to move by a threaded rod, such that the workpiece is clamped by the fixed jaw and the movable jaw. However, the vise can only clamp a sole workpiece at one time. In other words, it is troublesome to replace various workpieces when desiring to clamp these workpieces.

A conventional fixture structure is disclosed in TW Patent No. 339003 and contains two abutting blocks, two conical faces formed on the two abutting blocks, two push protrusions formed between the two conical faces of the two abutting blocks and having a same taper as a taper of the two conical faces. A threaded bolt passes through the two push blocks, and the two abutting blocks have two springs and two hooks configured to hook the two springs, two peripheral sheets disposed on the two abutting blocks, two defining projections formed on the two peripheral sheets and configured to abut against the two springs. Thereby, a head of the threaded bolt actuates the two push blocks to move when being screwed into a through hole of a work platform, and the two conical faces of the two push blocks press the two abutting blocks to extend, thus clamping the workpieces fixedly. Nevertheless, the workpiece slides and rotates easily when being clamped. Furthermore, the fixture structure can only clamp the workpiece of a fixed size.

To overcome above-mentioned problems, an improved fixture has been developed and is disclosed in TW Patent No. 1603807. The improved fixture contains a first column partially engaged in a first recess, and the first column has a first rough face exposing outside the first recess. The fixture further contains a second column rotatably engaged in a second recess partially and having a second rough face exposing outside the second recess. The fixture further contains a third resilient element and a fourth resilient element which are configured to push the first rough face and the second rough face to clamp the workpieces of different shapes. But the actuation block and a movable block move easily, when the actuation block urges at least one screw to clamp the workpieces.

Furthermore, the first movable block, the second moveable block, and the actuation block are complicated to increase manufacture and assembly difficulty.

The present invention has arisen to mitigate and/or obviate the afore-described disadvantages.

SUMMARY OF THE INVENTION

The primary aspect of the present invention is to provide a fixture which is mounted on the work platform, and a workpiece is fixed between any two adjacent fixtures so that when the threaded bolt is screwed into the actuation block, the first movable block and the second movable block are moved to clamp the workpiece, and the first tilted face of the first movable block and the second tilted face of the second movable block are formed in an inverted Z shape so that when the threaded bolt is screwed into the actuation block, the actuation block does not swing, and the workpiece is clamped by the fixture securely.

To obtain above-mentioned aspect, a fixture provided by the present invention is mounted on a work platform, and the fixture contains: a first movable block, a second movable block, an actuation block, multiple resilient elements, multiple first connection blots corresponding to the multiple resilient elements, and a threaded bolt.

The first movable block includes a first body formed in a trapezoid shape, and the first body has a first tilted face, a first defining portion, and a first clamping face. The first tilted face is defined on a peripheral wall of the first body and extending from a bottom of the peripheral wall of the first body to a top of the peripheral wall of the first body. The first tilted face has a first slide section in an inverted Z shape, a second slide section, and a first stop section. The first defining portion is defined on a center of the first slide section and the second slide section of the first tilted face, and the first stop section has a first notch parallel to the first tilted face.

The second movable block corresponds to the first movable block, and the second movable block includes a second body formed in a trapezoid shape, and the second body has a second tilted face, a second defining portion, and a second clamping face. The second tilted face is defined on a peripheral wall of the second body and extending from a bottom of the peripheral wall of the second body to a top of the peripheral wall of the second body, and the second tilted face has a third slide section in an inverted Z shape, a fourth slide section, and a second stop section. The second defining portion is defined on a center of the third slide section and the fourth slide section of the second tilted face, and the second stop section has a second notch parallel to the second tilted face.

The actuation block is defined between the first movable block and the second movable block, and the actuation block moves upward and downward in an accommodation space defined by the first movable block and the second movable block. The actuation block includes a third body formed in an inverted trapezoid shape, and the third body has a third tilted face, a fourth tilted face, at least one first abutting portion, at least second abutting portion, and a coupling orifice. The third tilted face corresponds to the first tilted face, and the third tilted face has a third defining portion formed on a center of the third tilted face and corresponding to the first defining portion. The third tilted face has a fifth slide section, a sixth slide section, and a third stop section. The first slide section corresponds to the fifth slide, the second slide section corresponds to the sixth slide section, and the first stop section corresponds to the third stop section, the third tilted face extends from a bottom of a first peripheral wall of the third body to a top of the first peripheral wall of the third body. The fourth tilted face corresponds to the second tilted face and has a fourth defining portion formed on a center of the fourth tilted face and correspond to the second defining portion, the fourth tilted face has a seventh slide section, an eighth slide section, and a fourth stop section. The third slide section corresponds to the seventh slide section, the fourth slide section corresponds to the eighth slide section, and the second stop section corresponds to the fourth stop section. The fourth tilted face extends from a bottom of a second peripheral wall of the third body to a top of the second peripheral wall of the third body.

The at least one first abutting portion corresponds to the first notch, the multiple first connection blots are fitted onto the multiple resilient elements and are locked in the first notch via the at least one first abutting portion; the at least one second abutting portion corresponds to the second notch, the multiple first connection blots are fitted onto the multiple resilient elements and are locked in the second notch via the at least one second abutting portion; the coupling orifice is defined on a center of the third body, and the threaded bolt is connected on the work platform and is rotated to drive the actuation block to move vertically after being inserted into the coupling orifice.

The threaded bolt is rotated to drive the actuation block to move, and the first movable block and the second movable block are driven by the actuation block to move horizontally. A moving travel of the actuation block is reduced by using the first slide section, the second slide section and the first stop section of the first tilted face, the third slide section, the fourth slide section and the second stop section of the second tilted face, the fifth slide section, the sixth slide section and the third stop section of the third tilted face, the seventh slide section, and the eighth slide section and the fourth stop section of the fourth tilted face, such that when the threaded bolt is screwed rotatably, the actuation block is driven by the threaded bolt to descend but not swing, and the fixture clamps a workpiece securely.

When the threaded bolt is rotated to remove from the actuation block, the multiple resilient elements of the multiple first connection blots push the actuation block upward, and the first movable block and the second movable block move inward to release the workpiece, such that the first movable block, the second movable block, and the actuation block do not remove by using the first defining portion, the second defining portion, the third defining portion, and the fourth defining portion.

Preferably, the actuation block includes a first protruded portion and a second protruded portion, the first protruded portion has multiple first discharge orifices, and the second protruded portion has multiple second discharge orifices, multiple covering plates are screwed on the multiple first discharge orifices and the multiple second discharge orifice by way of at least second connection bolts, and the multiple covering plates contact with the first movable block and the second movable block, such that the threaded bolt is screwed into or unscrewed from the actuation block so that the actuation block moves upward and downward vertically and does not swing.

Preferably, the first clamping face has multiple first screwing orifices, and the second clamping face has multiple second screwing orifice. The first clamping face further has a first fixing unit, and at least one third connection bolt is inserted into the first fixing unit to screw with the multiple first screwing orifices; the second clamping face has a second fixing unit, and the at least one third connection bolt is inserted into the second fixing unit to screw with the multiple second screwing orifices of the second clamping face, such that the first fixing unit and the second fixing unit clamp the workpiece firmly.

Thereby, the fixture has advantages as follows:

1. The threaded bolt is rotated to drive the actuation block to move, the first movable block and the second movable block moves horizontally, wherein a moving travel of the actuation block is reduced by using the first slide section, the second slide section and the first stop section of the first tilted face, the third slide section, the fourth slide section and the second stop section of the second tilted face, the fifth slide section, the sixth slide section and the third stop section of the third tilted face, the seventh slide section, and the eighth slide section and the fourth stop section of the fourth tilted face, such that when the threaded bolt is screwed rotatably, the actuation block is driven by the threaded bolt to descend but not swing, and the fixture clamps a workpiece P securely.

2. When the threaded bolt is rotated to remove from the actuation block, the multiple resilient elements of the multiple first connection blots push the actuation block upward, and the first movable block and the second movable block move inward to release the workpiece, such that the first movable block, the second movable block, and the actuation block do not remove by using the first defining portion, the second defining portion, the third defining portion, and the fourth defining portion.

3. The first clamping face and the second clamping face clamp the workpieces of various shapes flexibly.

DETAILED DESCRIPTION OF THE PREFERRED EMBODIMENTS

Figure 1:
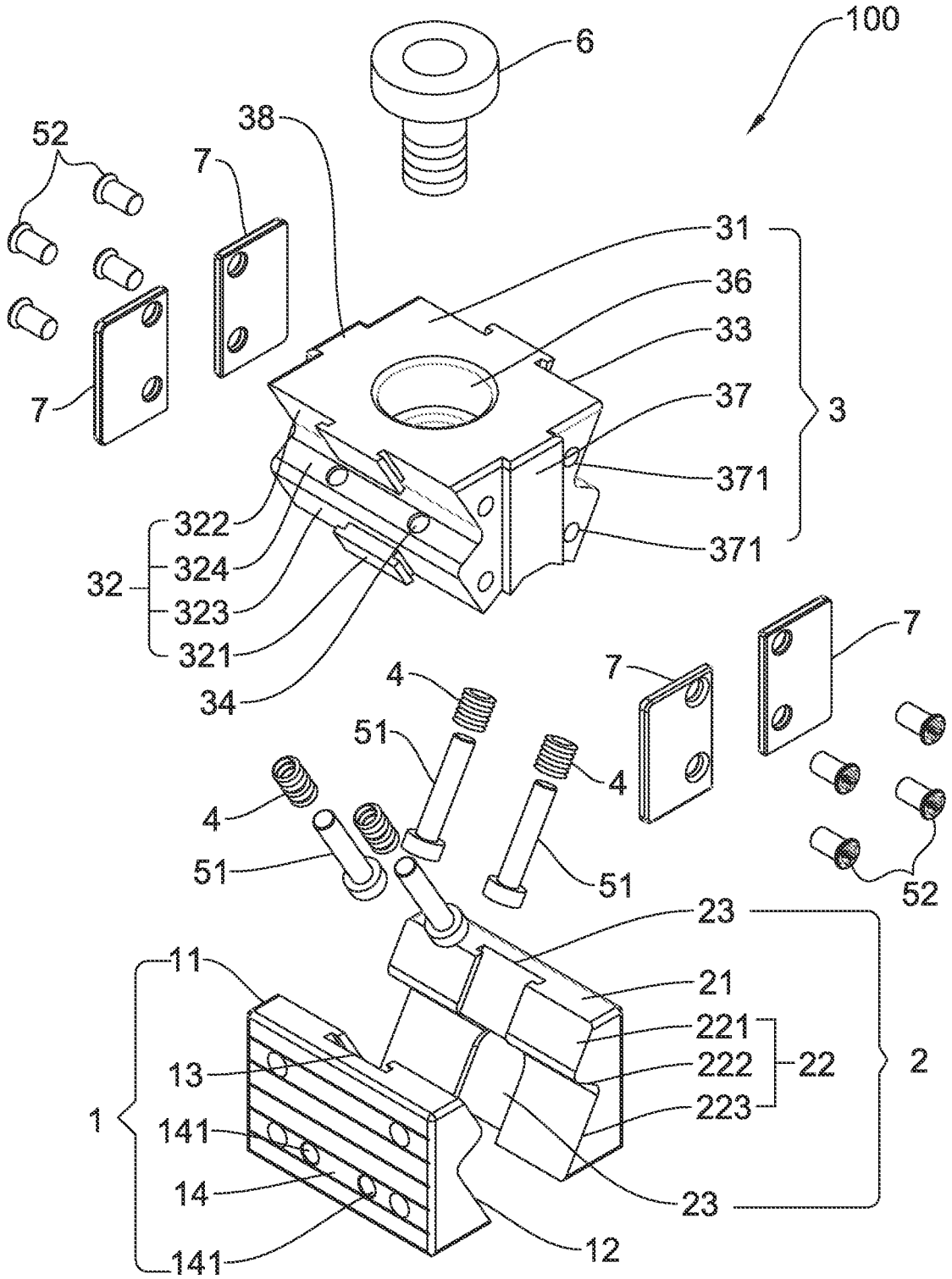
FIG. 1 is a perspective view showing the exploded components of a fixture according to a first embodiment of the present invention.
Figure 2:
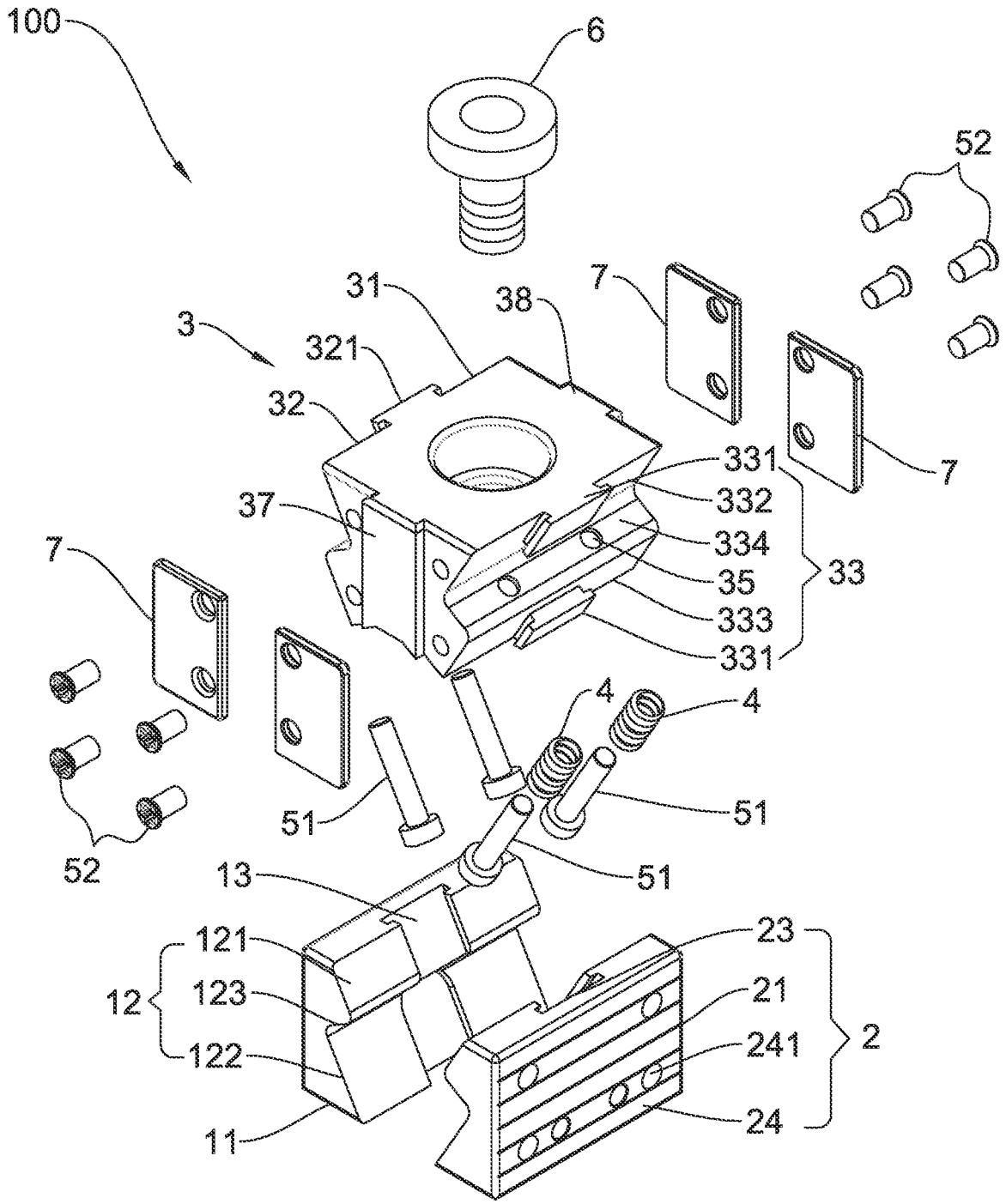
FIG. 2 is another perspective view showing the exploded components of the fixture according to the first embodiment of the present invention.
Figure 3:
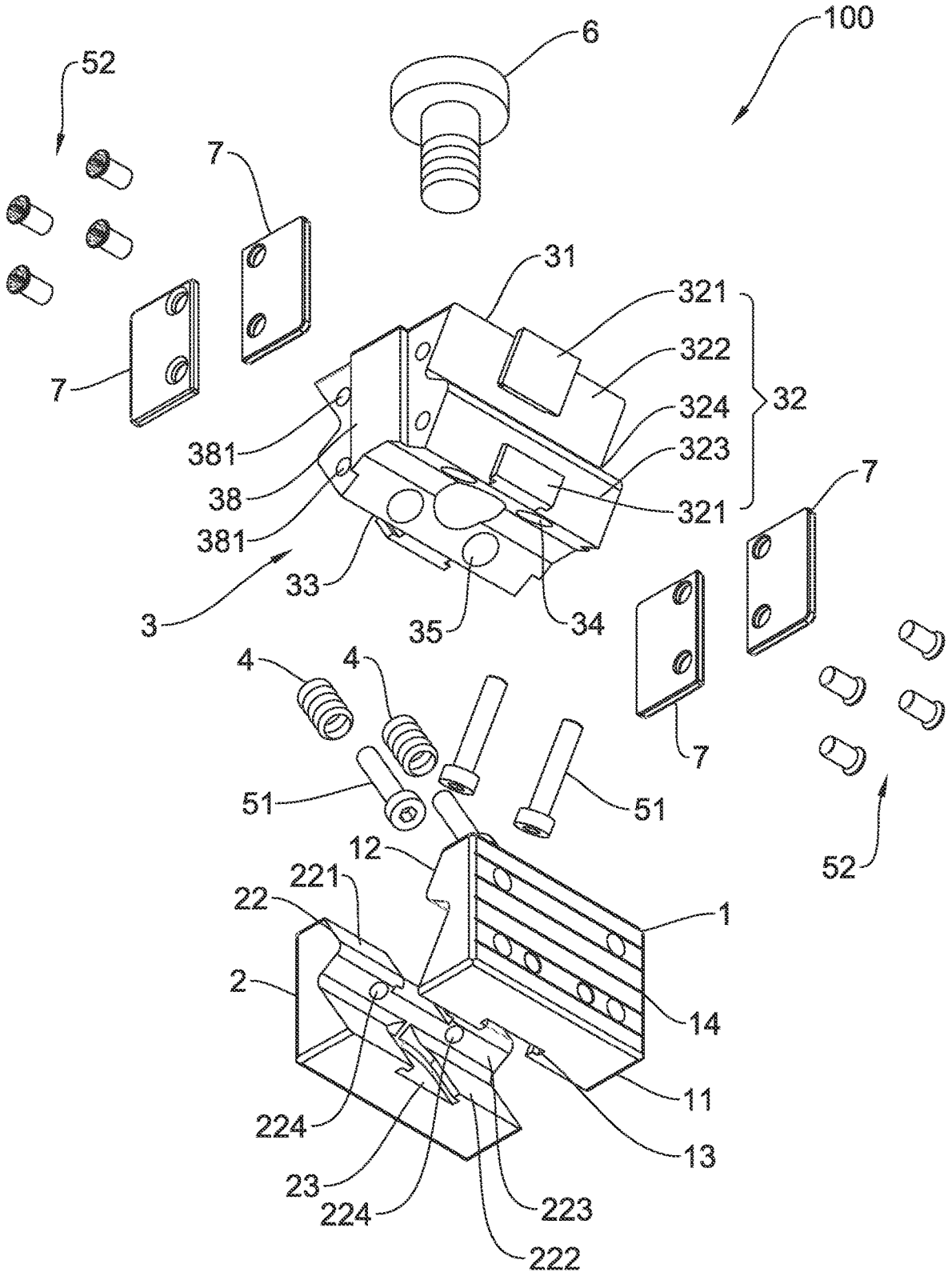
FIG. 3 is also another perspective view showing the exploded components of the fixture according to the first embodiment of the present invention.
Figure 4:
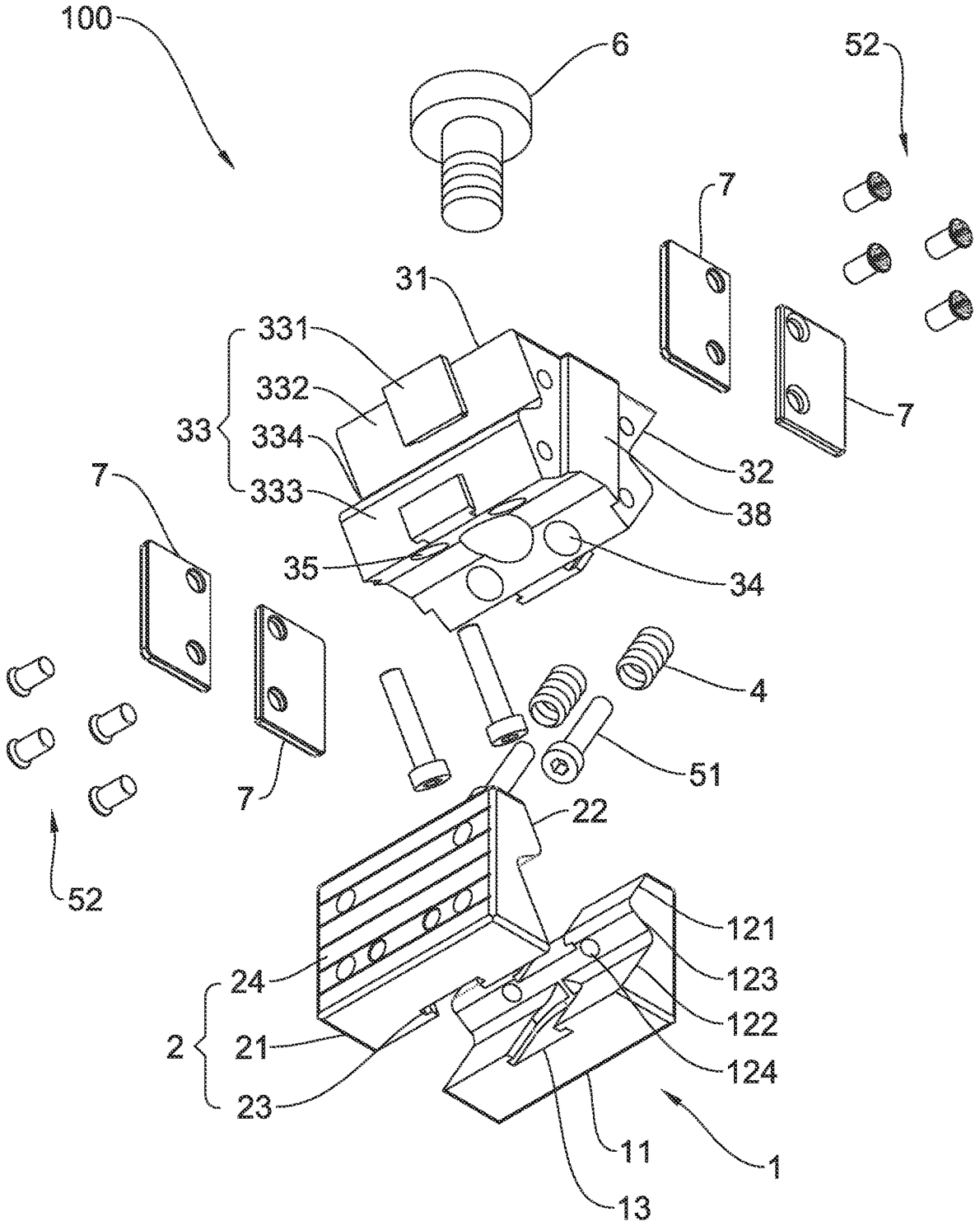
FIG. 4 is still another perspective view showing the exploded components of the fixture according to the first embodiment of the present invention.
Figure 5:
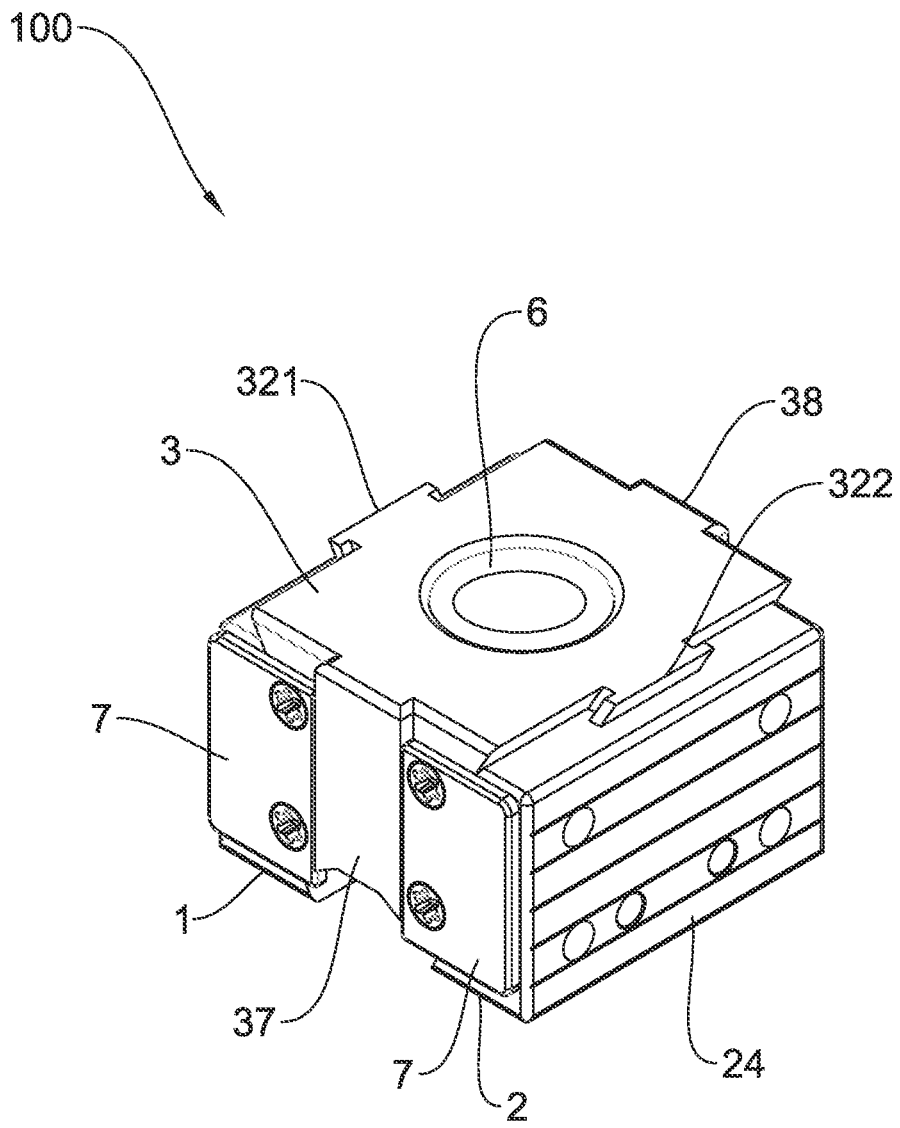
FIG. 5 is a perspective view showing the assembly of the fixture according to the first embodiment of the present invention.
Figure 6:
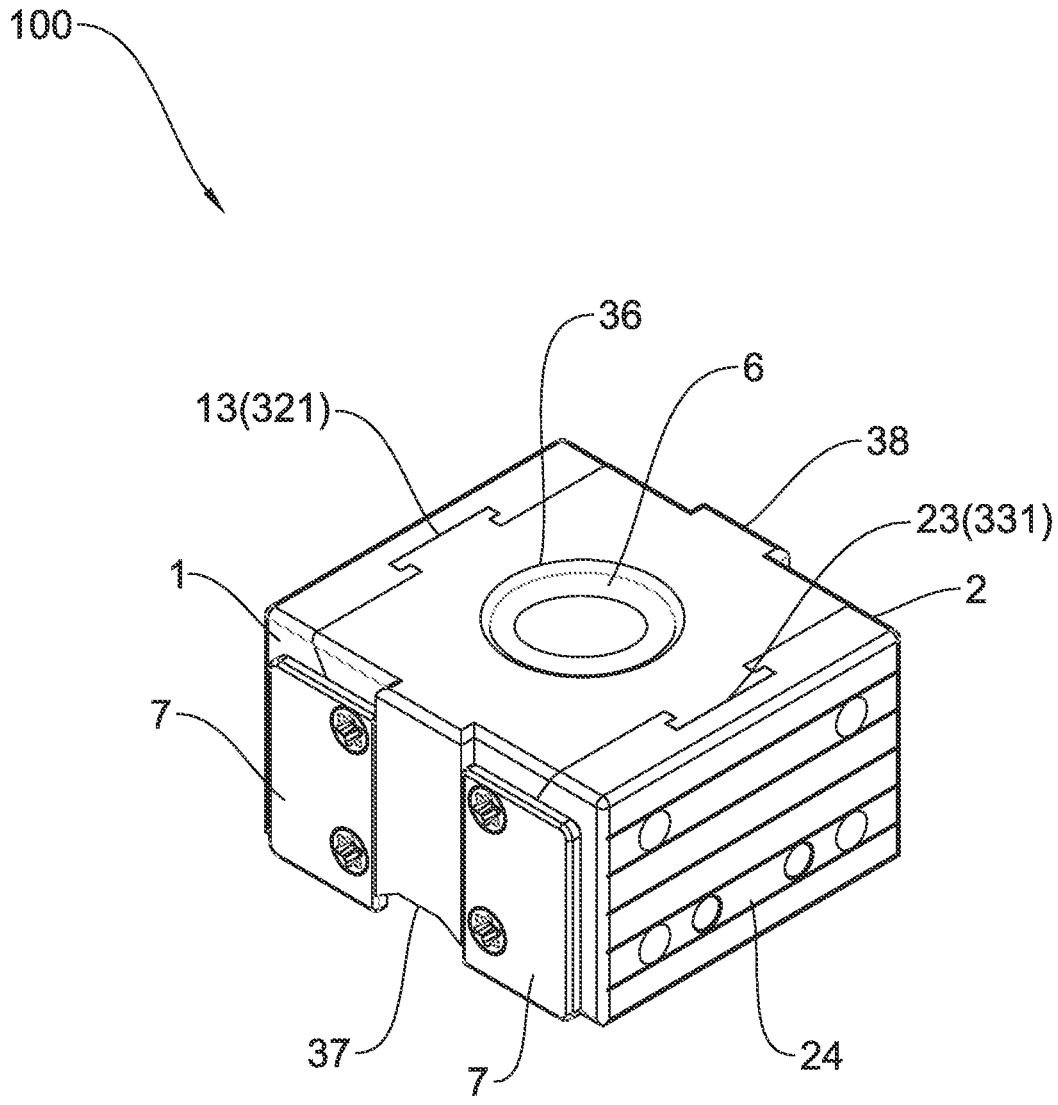
FIG. 6 is another perspective view showing the assembly of the fixture according to the first embodiment of the present invention.
Figure 7:
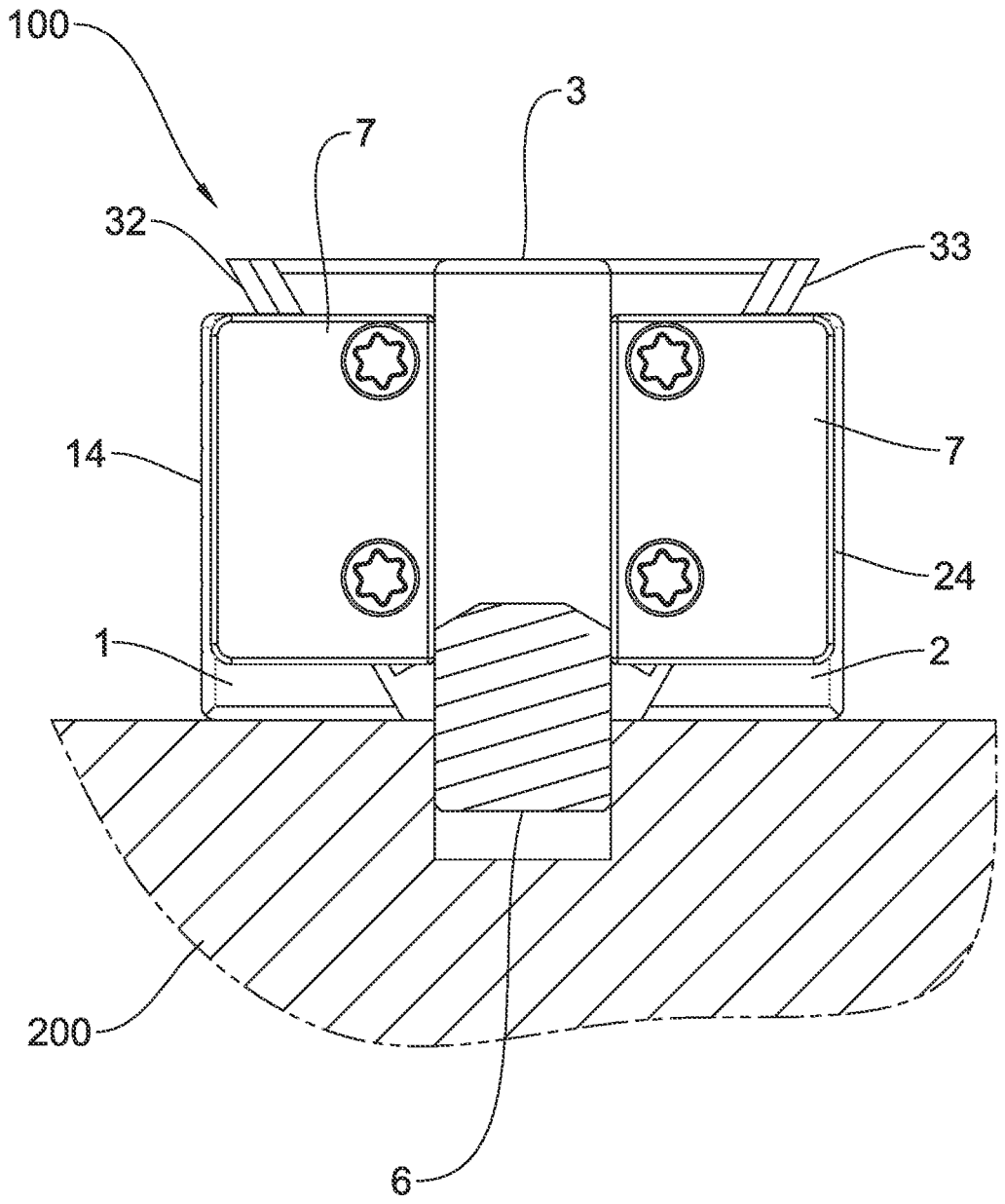
FIG. 7 is a cross sectional view showing the operation of the fixture according to the first embodiment of the present invention.

With reference to FIGS. 1 to 7, a fixture 100 according to a first embodiment of the present invention is mounted on a work platform 200, and the fixture 100 comprises a first movable block 1, a second movable block 2, an actuation block 3, multiple resilient elements 4, multiple first connection blots 51 corresponding to the multiple resilient elements 4, and a threaded bolt 6.

Referring to FIGS. 1 to 4, the first movable block 1 includes a first body 11 formed in a trapezoid shape, and the first body 11 has a first tilted face 12, a first defining portion 13, and a first clamping face 14, wherein the first tilted face 12 is defined on a peripheral wall of the first body 11 and extending from a bottom of the peripheral wall of the first body 11 to a top of the peripheral wall of the first body 11, wherein the first tilted face 12 has a first slide section 121 in an inverted Z shape, a second slide section 122, and a first stop section 123, wherein the first defining portion 13 is defined on a center of the first slide section 121 and the second slide section 122 of the first tilted face 12, and the first stop section 123 has a first notch 124 parallel to the first tilted face 12, wherein the first recess 124 is a blind hole.

As shown in FIGS. 1 to 4, the second movable block 2 corresponds to the first movable block 1, and the second movable block 2 includes a second body 21 formed in a trapezoid shape, and the second body 21 has a second tilted face 22, a second defining portion 23, and a second clamping face 24, wherein the second tilted face 22 is defined on a peripheral wall of the second body 21 and extending from a bottom of the peripheral wall of the second body 21 to a top of the peripheral wall of the second body 21, and the second tilted face 22 has a third slide section 221 in an inverted Z shape, a fourth slide section 222, and a second stop section 223, wherein the second defining portion 23 is defined on a center of the third slide section 221 and the fourth slide section 222 of the second tilted face 22, and the second stop section 223 has a second notch 224 parallel to the second tilted face 22, wherein the second recess 224 is a blind hole.

As illustrated in FIGS. 1 to 4, the actuation block 3 is defined between the first movable block 1 and the second movable block 2, and the actuation block 3 moves upward and downward in an accommodation space defined by the first movable block 1 and the second movable block 2, wherein the actuation block 3 includes a third body 31 formed in an inverted trapezoid shape, and the third body 31 has a third tilted face 32, a fourth tilted face 33, at least one first abutting portion 34, at least second abutting portion 35, and a coupling orifice 36, wherein the third tilted face 32 corresponds to the first tilted face 12, and the third tilted face 32 has a third defining portion 321 formed on a center of the third tilted face 32 and corresponding to the first defining portion 13, wherein the third tilted face 32 has a fifth slide section 322, a sixth slide section 323, and a third stop section 324, wherein the first slide section 121 corresponds to the fifth slide 322, the second slide section 122 corresponds to the sixth slide section 323, and the first stop section 123 corresponds to the third stop section 324. The third tilted face 32 extends from a bottom of a first peripheral wall of the third body 3 to a top of the first peripheral wall of the third body 3. The fourth tilted face 33 corresponds to the second tilted face 22 and has a fourth defining portion 331 formed on a center of the fourth tilted face 33 and correspond to the second defining portion 23. The fourth tilted face 33 has a seventh slide section 332, an eighth slide section 333, and a fourth stop section 334, wherein the third slide section 221 corresponds to the seventh slide section 332, the fourth slide section 222 corresponds to the eighth slide section 333, and the second stop section 223 corresponds to the fourth stop section 334, and the fourth tilted face 33 extends from a bottom of a second peripheral wall of the third body 3 to a top of the second peripheral wall of the third body 3.

With reference to FIGS. 1 to 7, the at least one first abutting portion 34 corresponds to the first notch 124, the multiple first connection blots 51 are fitted onto the multiple resilient elements 4 and are locked in the first notch 124 via the at least one first abutting portion 34. The at least one second abutting portion 35 corresponds to the second notch 224, the multiple first connection blots 51 are fitted onto the multiple resilient elements 4 and are locked in the second notch 224 via the at least one second abutting portion 35. The coupling orifice 36 is defined on a center of the third body 31, and the threaded bolt 6 is connected on the work platform 200 and is rotated to drive the actuation block 3 to move vertically after being inserted into the coupling orifice 36.

Figure 8:
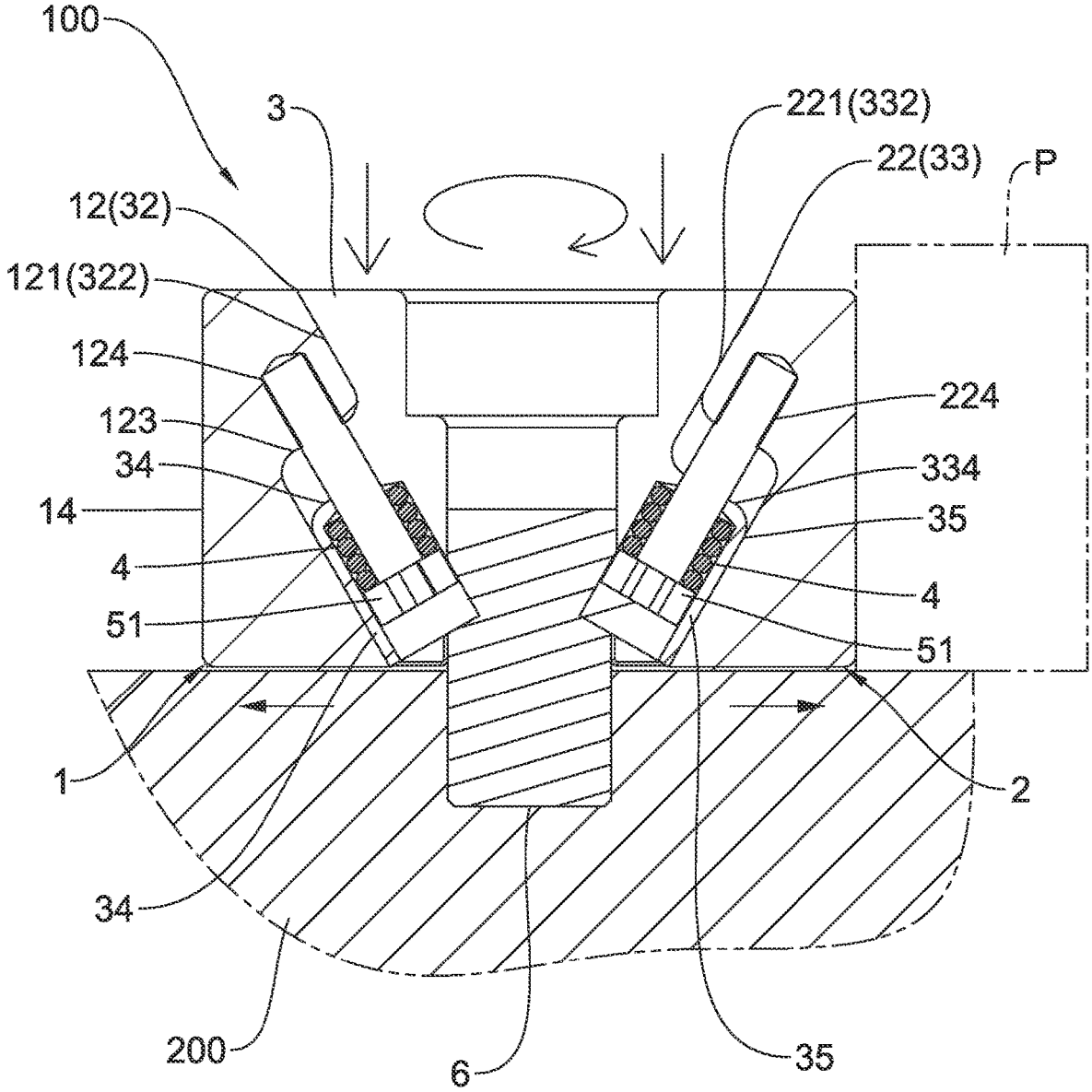
FIG. 8 is another cross sectional view showing the operation of the fixture according to the first embodiment of the present invention.

Referring to FIG. 8, the threaded bolt 6 is rotated to drive the actuation block 3 to move, and the first movable block 1 and the second movable block 2 are driven by the actuation block 3 to move horizontally, wherein a moving travel of the actuation block 3 is reduced by using the first slide section 121, the second slide section 122 and the first stop section 123 of the first tilted face 12, the third slide section 221, the fourth slide section 222 and the second stop section 223 of the second tilted face 22, the fifth slide section 32, the sixth slide section 323 and the third stop section 324 of the third tilted face 32, the seventh slide section 332, and the eighth slide section 333 and the fourth stop section 334 of the fourth tilted face 33, such that when the threaded bolt 6 is screwed rotatably, the actuation block 3 is driven by the threaded bolt 6 to descend but not swing, and the fixture 100 clamps a workpiece P securely.

Figure 9:
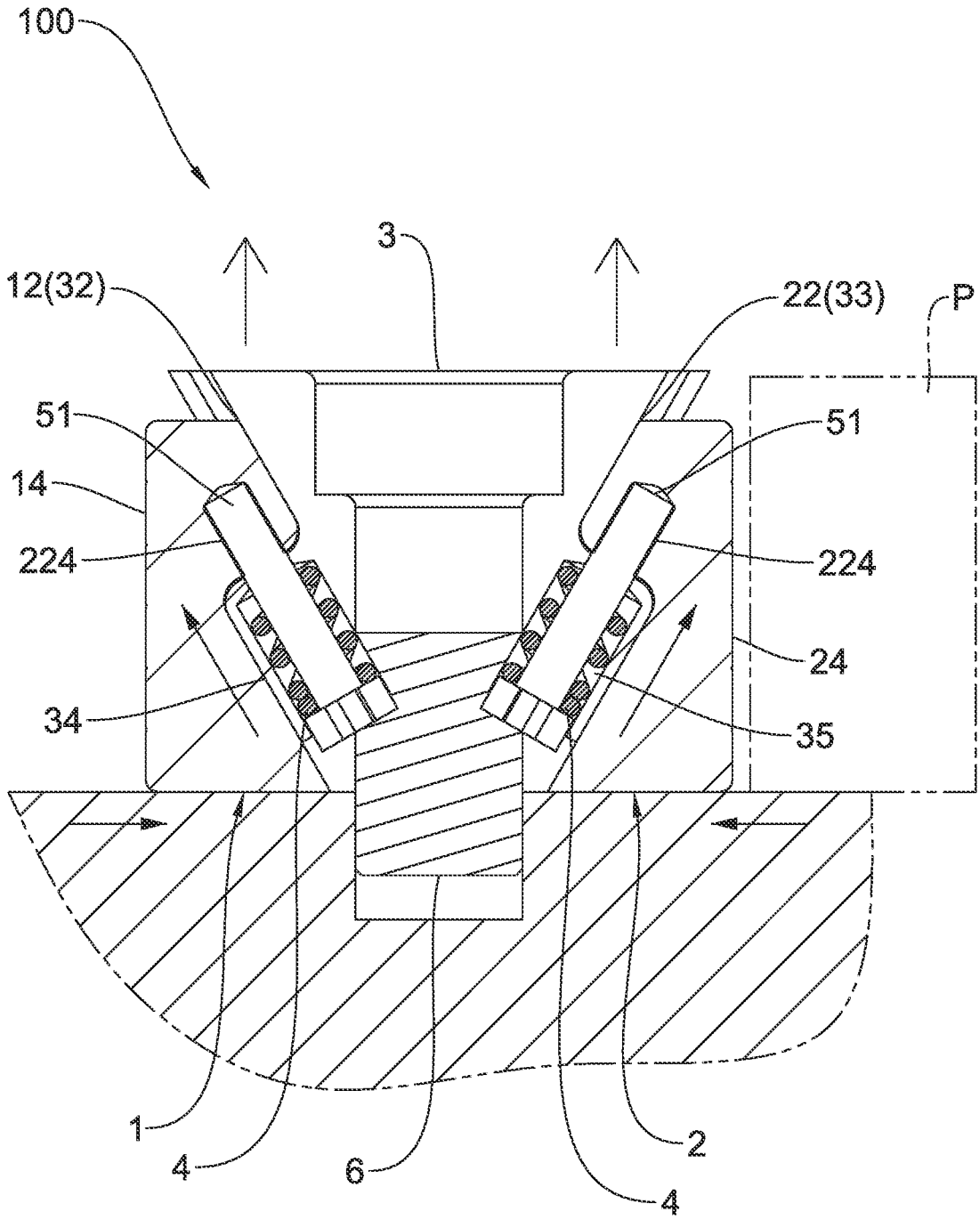
FIG. 9 is still another cross sectional view showing the operation of the fixture according to the first embodiment of the present invention.

As shown in FIG. 9, when the threaded bolt 6 is rotated to remove from the actuation block 3, the multiple resilient elements 4 of the multiple first connection blots 51 push the actuation block 3 upward, and the first movable block 1 and the second movable block 2 move inward to release the workpiece P, such that the first movable block 1, the second movable block 2, and the actuation block 3 do not remove by using the first defining portion 13, the second defining portion 23, the third defining portion 321, and the fourth defining portion 331.

As illustrated in FIGS. 1 to 6, the actuation block 3 includes a first protruded portion 37 and a second protruded portion 38, wherein the first protruded portion 37 has multiple first discharge orifices 371, and the second protruded portion 38 has multiple second discharge orifices 381, wherein multiple covering plates 7 are screwed on the multiple first discharge orifices 371 and the multiple second discharge orifice 381 by way of at least second connection bolts 52, and the multiple covering plates 7 contact with the first movable block 1 and the second movable block 2, such that the threaded bolt 6 is screwed into or unscrewed from the actuation block 3 so that the actuation block 3 moves upward and downward vertically and does not swing.

Figure 10:
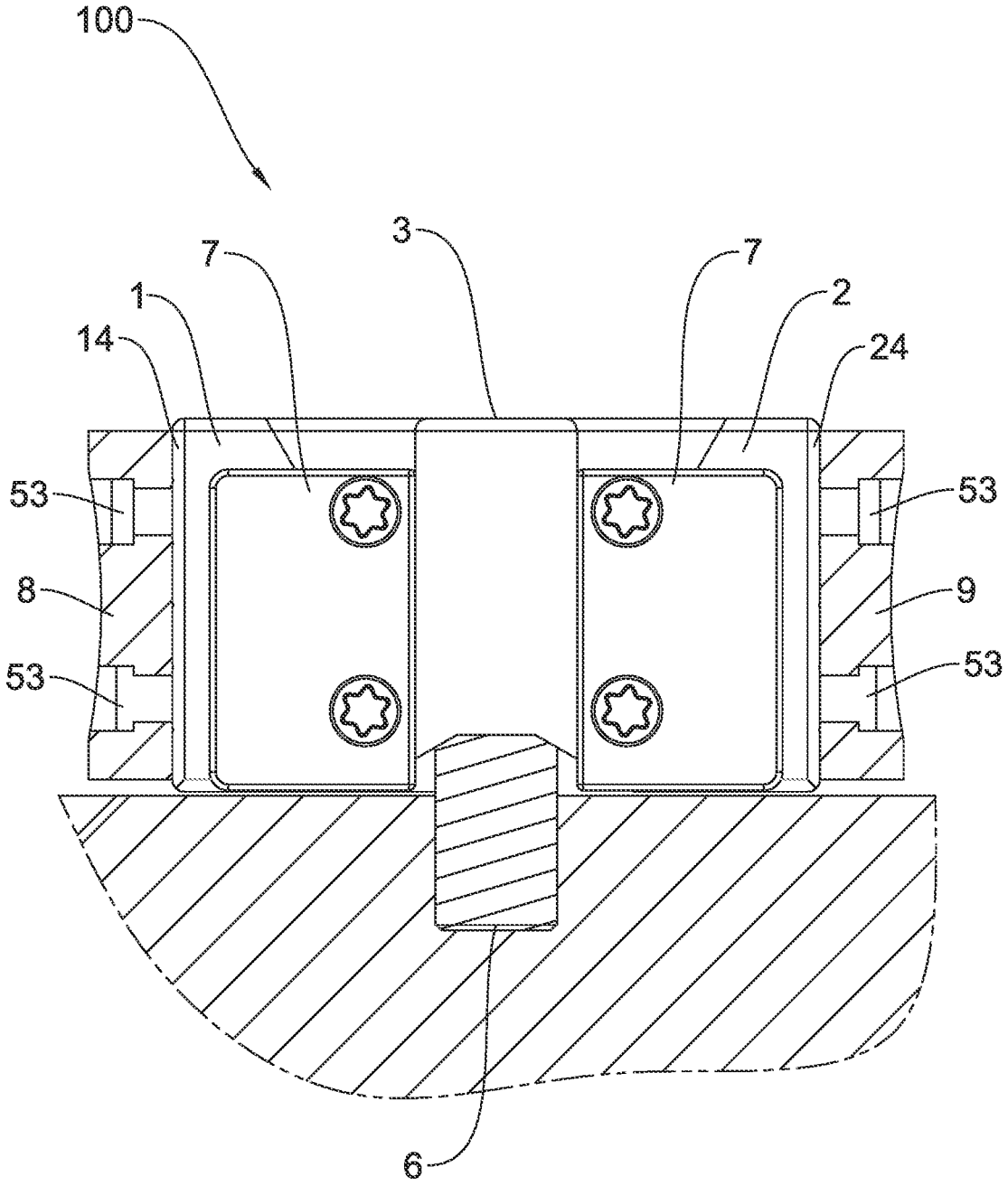
FIG. 10 is a cross sectional view showing the operation of the fixture according to the first embodiment of the present invention.

With reference to FIG. 10, the first clamping face 14 has multiple first screwing orifices 141, and the second clamping face 24 has multiple second screwing orifice 241, wherein the first clamping face 14 further has a first fixing unit 8, and at least one third connection bolt 53 is inserted into the first fixing unit 8 to screw with the multiple first screwing orifices 141. The second clamping face 24 has a second fixing unit 9, and the at least one third connection bolt 53 is inserted into the second fixing unit 9 to screw with the multiple second screwing orifices 241 of the second clamping face 24, such that the first fixing unit 8 and the second fixing unit 9 clamp the workpiece firmly.

Figure 11:
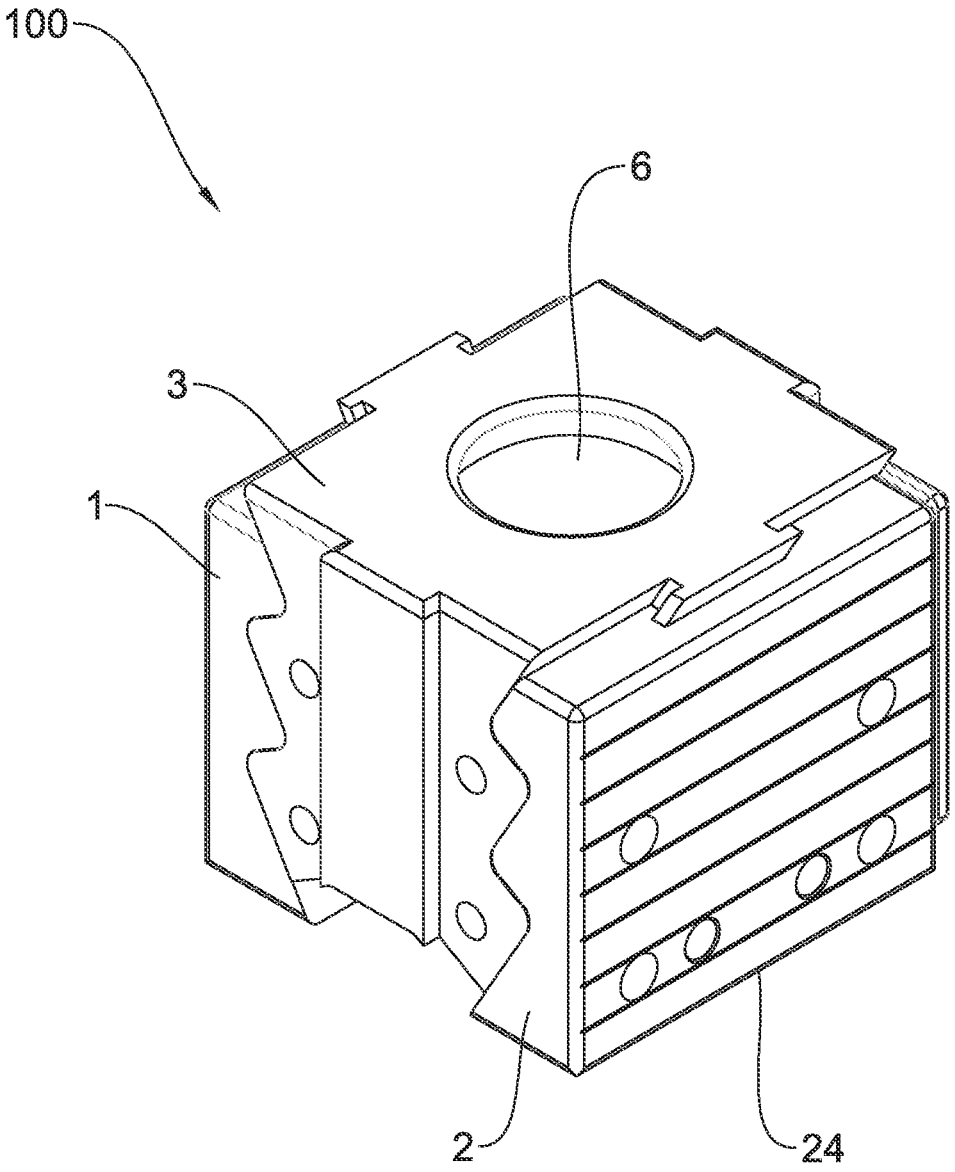
FIG. 11 is a perspective view showing the application of the fixture according to the first embodiment of the present invention.
Figure 12:
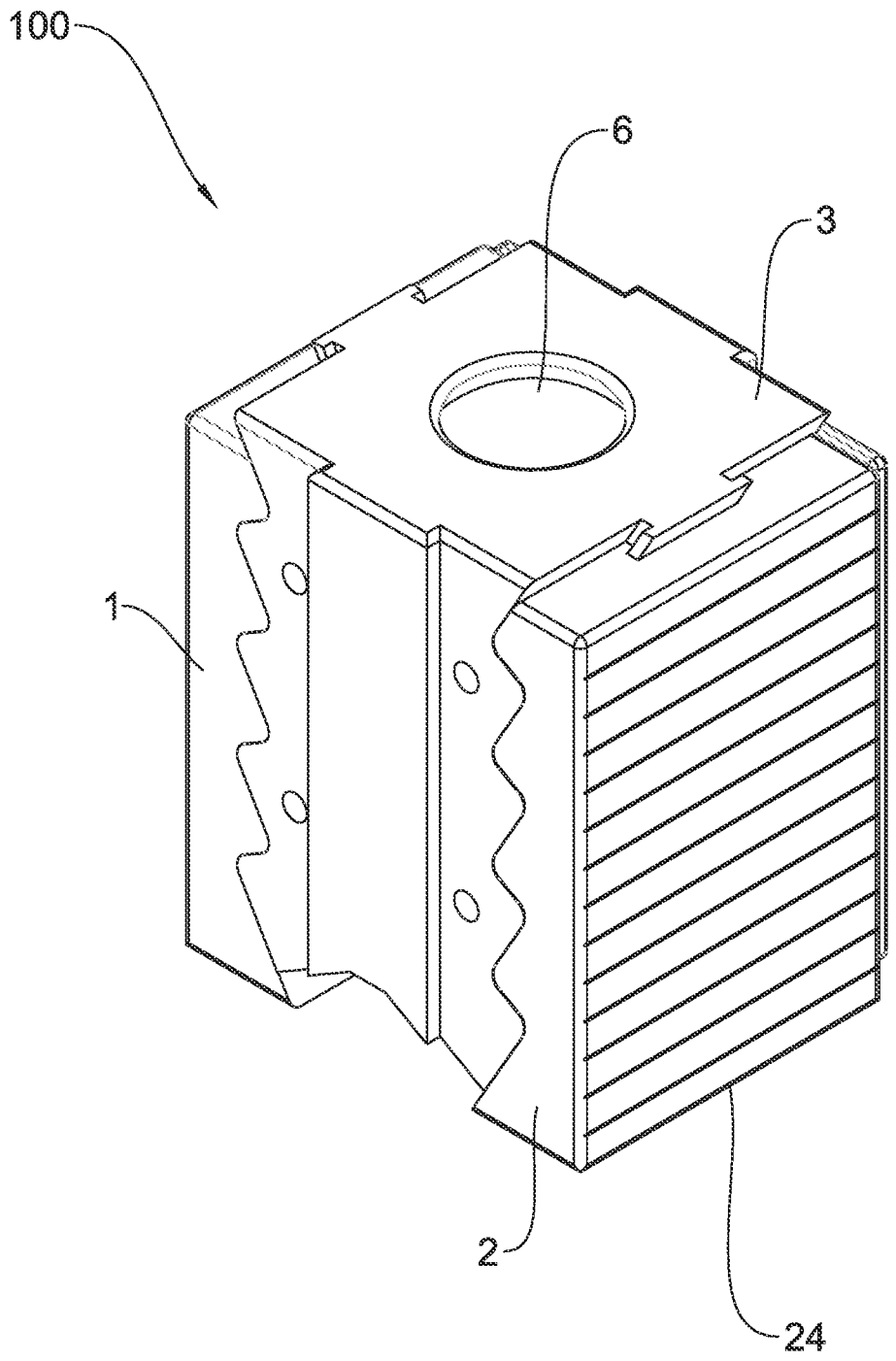
FIG. 12 is another perspective view showing the application of the fixture according to the first embodiment of the present invention.

Referring to FIGS. 11 and 12, when the workpiece is higher than the first movable block 1, the second movable block 2 and the actuation block 3, the fixture 100 comprises three slide sections and two stop sections. As shown in FIG. 12, the fixture 100 comprises five slide sections and fourth stop sections so as to fix the workpiece securely.

Figure 13:
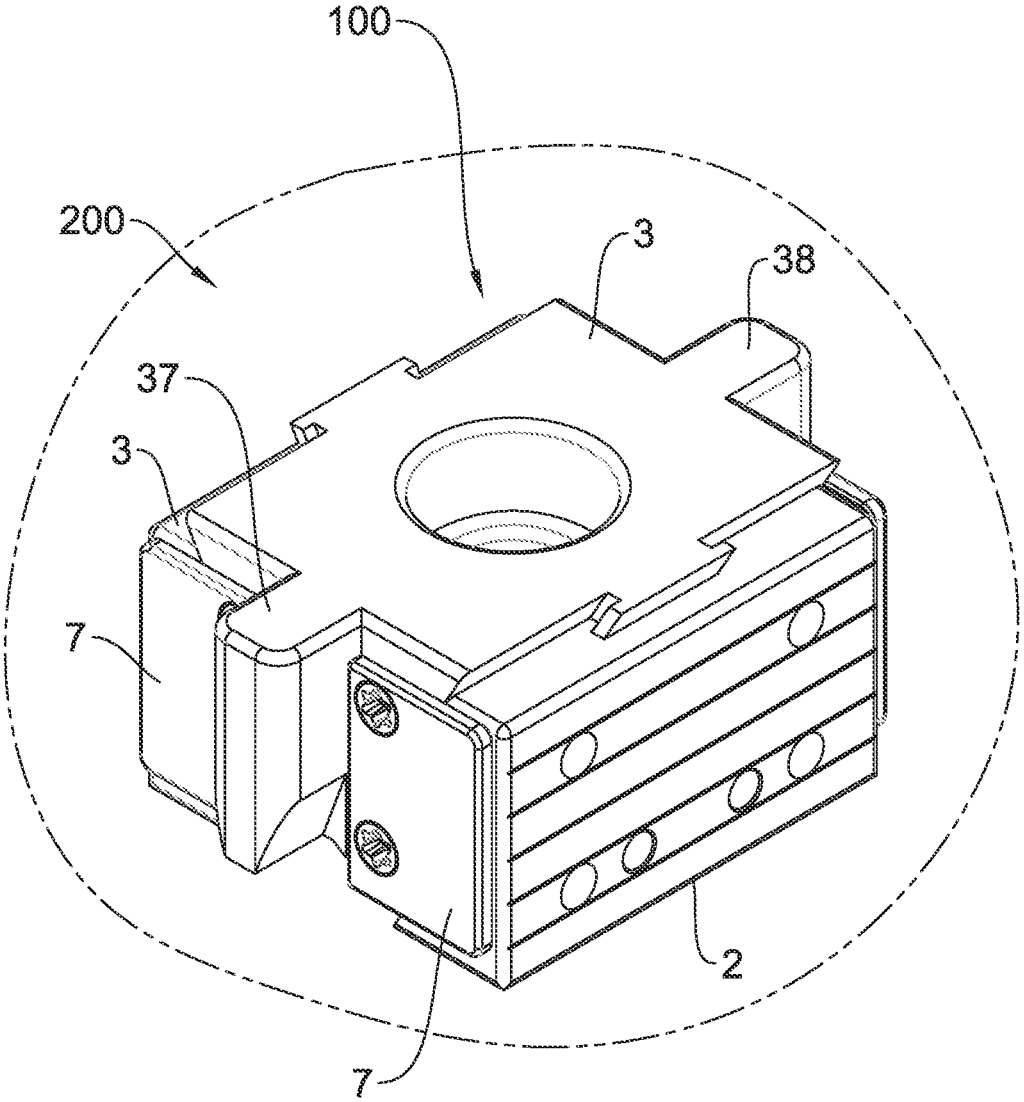
FIG. 13 is a perspective view showing the assembly of a fixture according to a second embodiment of the present invention.
Figure 14:
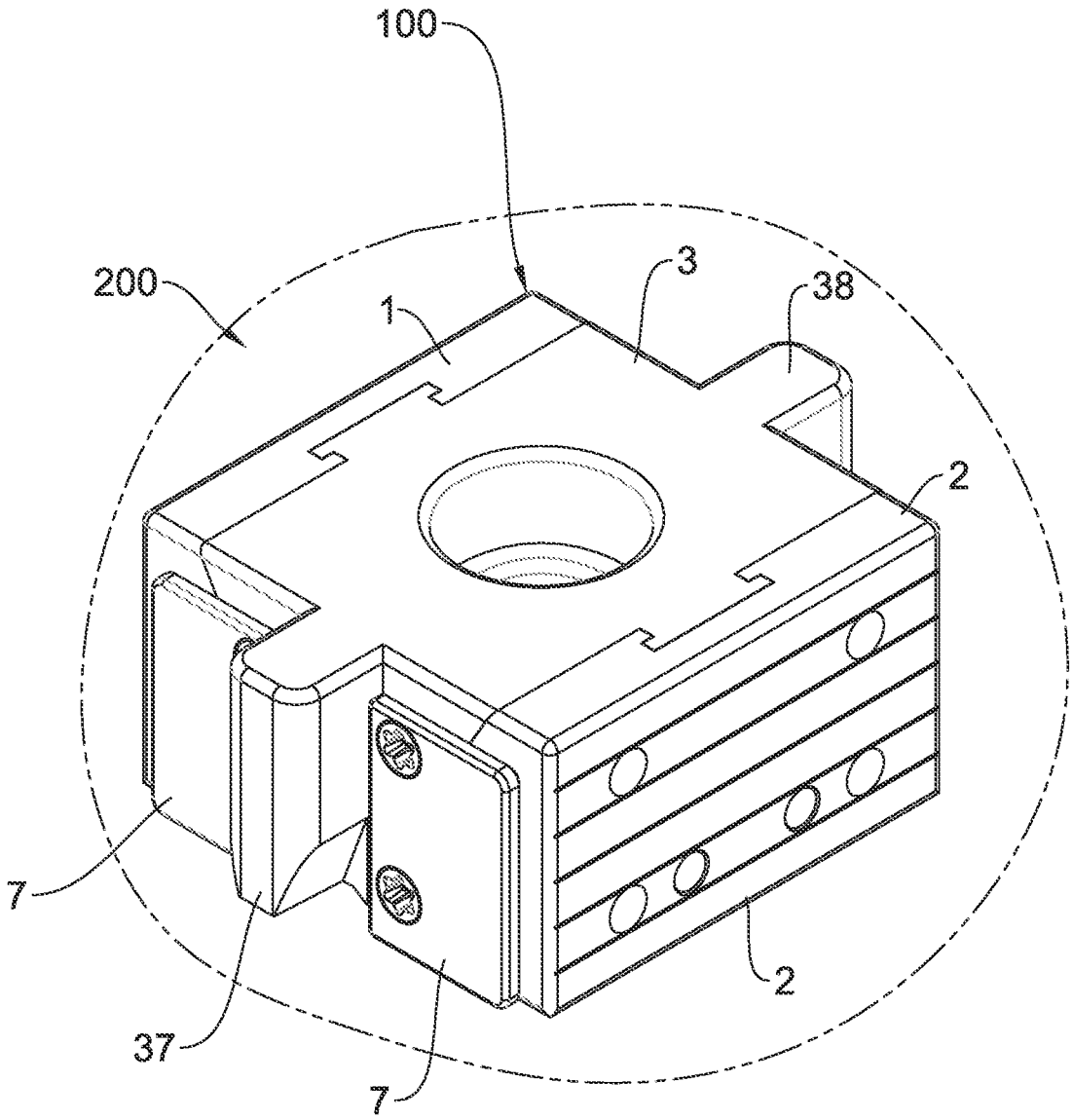
FIG. 14 is another perspective view showing the assembly of the fixture according to the second embodiment of the present invention.

As illustrated in FIGS. 13 and 14, a length of a first protruded portion 37 and a length of a second protruded portion 38 of a second embodiment are more than a length of the first protruded portion 37 and a length of the second protruded portion 38 of the first embodiment, wherein the work platform 200 includes a receiving groove configured to accommodate the first protruded portion 37 and second protruded portion 38, such that when the actuation block 3 is driven by the threaded bolt 6 to descend, the first protruded portion 37 and the second protruded portion 38 are moved into the receiving groove so that the actuation block 3 is covered by the covering plate 7 and does not deform when the threaded bolt 6 is rotated, thus moving the first movable block 1, the second movable block 2, and the actuation block 3 upward and downward vertically.

While the preferred embodiments of the invention have been set forth for purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A fixture being mounted on a work platform, and the fixture comprising: a first movable block, a second movable block, an actuation block, multiple resilient elements, multiple first connection blots corresponding to the multiple resilient elements, and a threaded bolt;

wherein the first movable block includes a first body formed in a trapezoid shape, and the first body has a first tilted face, a first defining portion, and a first clamping face, wherein the first tilted face is defined on a peripheral wall of the first body and extending from a bottom of the peripheral wall of the first body to a top of the peripheral wall of the first body, wherein the first tilted face has a first slide section in an inverted Z shape, a second slide section, and a first stop section, wherein the first defining portion is defined on a center of the first slide section and the second slide section of the first tilted face, and the first stop section has a first notch parallel to the first tilted face;

wherein the second movable block corresponds to the first movable block, and the second movable block includes a second body formed in a trapezoid shape, and the second body has a second tilted face, a second defining portion, and a second clamping face, wherein the second tilted face is defined on a peripheral wall of the second body and extending from a bottom of the peripheral wall of the second body to a top of the peripheral wall of the second body, and the second tilted face has a third slide section in an inverted Z shape, a fourth slide section, and a second stop section, wherein the second defining portion is defined on a center of the third slide section and the fourth slide section of the second tilted face, and the second stop section has a second notch parallel to the second tilted face;

wherein the actuation block is defined between the first movable block and the second movable block, and the actuation block moves upward and downward in an accommodation space defined by the first movable block and the second movable block, wherein the actuation block includes a third body formed in an inverted trapezoid shape, and the third body has a third tilted face, a fourth tilted face, at least one first abutting portion, at least second abutting portion, and a coupling orifice, wherein the third tilted face corresponds to the first tilted face, and the third tilted face has a third defining portion formed on a center of the third tilted face and corresponding to the first defining portion, wherein the third tilted face has a fifth slide section, a sixth slide section, and a third stop section, wherein the first slide section corresponds to the fifth slide, the second slide section corresponds to the sixth slide section, and the first stop section corresponds to the third stop section, the third tilted face extends from a bottom of a first peripheral wall of the third body to a top of the first peripheral wall of the third body; wherein the fourth tilted face corresponds to the second tilted face and has a fourth defining portion formed on a center of the fourth tilted face and correspond to the second defining portion, the fourth tilted face has a seventh slide section, an eighth slide section, and a fourth stop section, wherein the third slide section corresponds to the seventh slide section, the fourth slide section corresponds to the eighth slide section, and the second stop section corresponds to the fourth stop section, wherein the fourth tilted face extends from a bottom of a second peripheral wall of the third body to a top of the second peripheral wall of the third body;

wherein the at least one first abutting portion corresponds to the first notch, the multiple first connection blots are fitted onto the multiple resilient elements and are locked in the first notch via the at least one first abutting portion; the at least one second abutting portion corresponds to the second notch, the multiple first connection blots are fitted onto the multiple resilient elements and are locked in the second notch via the at least one second abutting portion; the coupling orifice is defined on a center of the third body, and the threaded bolt is connected on the work platform and is rotated to drive the actuation block to move vertically after being inserted into the coupling orifice;

wherein the threaded bolt is rotated to drive the actuation block to move, and the first movable block and the second movable block are driven by the actuation block to move horizontally, wherein a moving travel of the actuation block is reduced by using the first slide section, the second slide section and the first stop section of the first tilted face, the third slide section, the fourth slide section and the second stop section of the second tilted face, the fifth slide section, the sixth slide section and the third stop section of the third tilted face, the seventh slide section, and the eighth slide section and the fourth stop section of the fourth tilted face, such that when the threaded bolt is screwed rotatably, the actuation block is driven by the threaded bolt to descend but not swing, and the fixture clamps a workpiece securely; and wherein when the threaded bolt is rotated to remove from the actuation block, the multiple resilient elements of the multiple first connection blots push the actuation block upward, and the first movable block and the second movable block move inward to release the workpiece, such that the first movable block, the second movable block, and the actuation block do not remove by using the first defining portion, the second defining portion, the third defining portion, and the fourth defining portion.

2. The fixture as claimed in claim 1, wherein the actuation block includes a first protruded portion and a second protruded portion, wherein the first protruded portion has multiple first discharge orifices, and the second protruded portion has multiple second discharge orifices, wherein multiple covering plates are screwed on the multiple first discharge orifices and the multiple second discharge orifice by way of at least second connection bolts, and the multiple covering plates contact with the first movable block and the second movable block, such that the threaded bolt is screwed into or unscrewed from the actuation block so that the actuation block moves upward and downward vertically and does not swing.

3. The fixture as claimed in claim 1, wherein the first clamping face has multiple first screwing orifices, and the second clamping face has multiple second screwing orifice, wherein the first clamping face further has a first fixing unit, and at least one third connection bolt is inserted into the first fixing unit to screw with the multiple first screwing orifices; the second clamping face has a second fixing unit, and the at least one third connection bolt is inserted into the second fixing unit to screw with the multiple second screwing orifices of the second clamping face, such that the first fixing unit and the second fixing unit clamp the workpiece firmly.

4. The fixture as claimed in claim 1 further comprising multiple slide sections and multiple stop sections.

5. The fixture as claimed in claim 1, wherein the work platform includes a receiving groove configured to accommodate the first protruded portion and second protruded portion, such that when the actuation block is driven by the threaded bolt to descend, the first protruded portion and the second protruded portion are moved into the receiving groove so that the actuation block is covered by the covering plate and does not deform when the threaded bolt is rotated, thus moving the first movable block, the second movable block, and the actuation block upward and downward vertically.

* * * * *